United States Patent [19]

Terada et al.

[11] Patent Number: 4,852,664

[45] Date of Patent: Aug. 1, 1989

[54] HYDRAULIC IMPACT TOOL

[75] Inventors: Hiromu Terada, Ikoma, Japan; Hiroshi Okada, Suita, both of Japan

[73] Assignee: Nippon Pneumatic Manufacturing Co., Ltd., Osaka, Japan

[21] Appl. No.: 185,674

[22] Filed: Apr. 25, 1988

[51] Int. Cl.[4] ..... B25D 9/00

[52] U.S. Cl. ..... 173/134; 173/119; 91/398; 91/403; 91/404

[58] Field of Search ..... 173/116, 119, 134; 91/398, 403, 404

[56] References Cited

U.S. PATENT DOCUMENTS

| | | | |
|---|---|---|---|
| 3,701,386 | 10/1972 | Feucht | 173/116 X |
| 3,741,316 | 6/1973 | Alajouanine | 173/116 X |
| 4,034,817 | 7/1977 | Okada | 173/116 X |

*Primary Examiner*—Frank T. Yost

*Assistant Examiner*—James L. Wolfe

*Attorney, Agent, or Firm*—Armstrong, Nikaido, Marmelstein, Kubovcik & Murray

[57] ABSTRACT

An impact tool for striking a tool such as a chisel includes a piston mounted in a cylinder. Upper, middle and lower chambers are formed therebetween. Pressure oil is fed into and discharged from the middle and lower chambers to reciprocate the piston in the cylinder under oil pressure. During a downward stroke of the piston, the oil pressure in the lower chamber is kept low. But just before it strikes a tool, the oil pressure in the lower chamber is adapted to increase so as to prevent what is called cavitation or prevent air bubbles mixed in the pressure oil in the lower chamber from growing suddenly owing to a sharp drop in the oil pressure which is caused by the rebound of the piston after striking the tool.

2 Claims, 3 Drawing Sheets

HYDRAULIC IMPACT TOOL

BACKGROUND OF THE INVENTION

The present invention relates to a hydraulic impact tool adapted to be mounted on the head of a hydraulic power shovel or the like and used to demolish a concrete structure, to crush rocks, to excavate a rock base, or the like.

Hydraulic impact tools can be classified roughly into an accumulator type and a gas pressure type.

With an accumulator type tool, pressurized oil is accumulated in an accumulator while a piston is rising and is released during its downward stroke to accelerate the piston.

With a gas pressure type tool, one example of which is disclosed in the Japanese Patent Publication No. 54-32192, a piston compresses a gas filled in the space above the piston to store energy when it rises under oil pressure. During its downward stroke, the compressed gas expands to accelerate the piston. The impact tool disclosed in the abovesaid Publication is shown in FIG. 6 in which numeral 1 designates a cylinder having a tool 2 such as a chisel slidably mounted in the lower end thereof.

A piston 4 formed with a large-diameter portion 3 is mounted in the cylinder 1 to strike the tool 2. The cylinder 1 has an upper chamber 5 charged with gas over the piston 4 to exert the gas pressure to the piston 4 as it reaches its upper limit.

The piston 4 has small-diameter portions over and under the large-diameter portion 3. A middle chamber 6 and a lower chamber 7 are formed between the small-diameter portions and the inner periphery of the cylinder 1.

A valve chest 8 is formed at one side of the cylinder 1. A valve body 10 formed with a center bore is mounted in the valve chest 8. The valve chest communicates with the cylinder 1 through oil channels extending from the upper and lower parts of the former to the upper part of the middle chamber 6 and to the lower part of the lower chamber 7, respectively. Further, the cylinder 1 and the valve chest 8 have their respective mid-portions communicating with each other by means of one main oil channel and a branch channel.

The valve chest 8 has its upper and lower parts connected to a discharge port 11 and an oil feed port 12, respectively. From the oil feed port 12, another oil channel branches and leads to the top end of a plunger 13 for pressing down the valve body 10.

In operation, when the valve body 10 is at its lower limit, pressure oil is supplied through the oil feed port 12 to pressurize the lower chamber 7. Since the middle chamber 6 is open to the discharge port 11, the piston 4 rises up the cylinder to compress the gas in the upper chamber 5.

When the piston 4 approaches the uppermost position, the oil feed port 12 gets into communication with the middle oil channels through which pressure oil flows into the valve chest 8 to push up the valve body 10. As soon as the valve body 10 clears the bottom of the valve chest 8, the lower chamber 7 communicates with the discharge port 11 through the bore in the valve body 10. Thus, the piston 4 is pushed down by the pressure of gas in the upper chamber 5 to strike the tool 2.

With this prior art impact tool, when the piston 4 rebounds violently immediately after striking the tool 2, the pressure in the lower chamber 7 drops sharply because the chamber 7 is open to the discharge port 11, thus allowing air bubbles in the hydraulic oil to grow rapidly. This phenomenon is called cavitation. When the valve body 10 descends thereafter and pressure oil flows back into the lower chamber 7, the air bubbles which have grown large collapse in an instant, producing a very high pressure and a shock wave. This happens repeatedly several hundred times a minute. Thus, the piston 4 and the cylinder 1 tend to develop erosion on their surface after long use.

SUMMARY OF THE INVENTION

It is an object of the present invention to provide an impact tool which is less susceptible to erosion on the surface of its piston and cylinder owing to the cavitation.

According to the present invention, when both the valve body and the piston are at their lowermost position, the oil feed port communicates with the lower chamber whereas the middle chamber communicates with the discharge port. Thus the piston is pushed up, compressing the gas in the upper chamber.

While the piston is climbing up the cylinder, the oil pressure acting on the valve body pushes it up against the force urging the valve body downwardly, bringing the lower and middle chambers into communication with the discharge port. When the piston begins to go down and the valve body rises to the uppermost level, the middle and lower chambers communicate with the oil feed port. The lower chamber is kept under high oil pressure until the piston strikes the tool. Even when the piston rebounds immediately thereafter, the lower chamber will not suffer a sharp pressure drop, preventing the development of air bubbles in the pressure oil and the occurrence of cavitation.

Other features and objects of the present invention will become apparent from the following description taken with reference to the accompanying drawings, in which:

DETAILED DESCRIPTION OF THE PREFERRED EMBODIMENT

Figure 1:
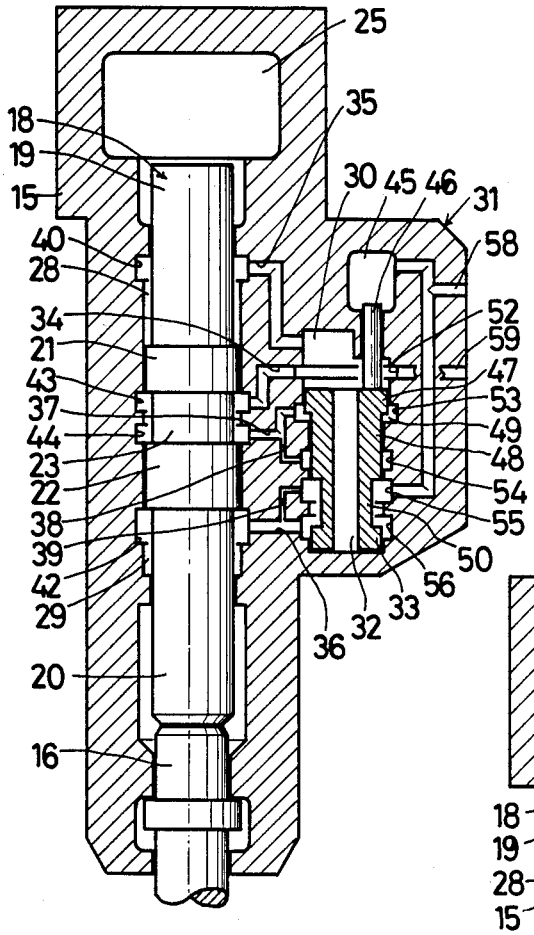
FIGS. 1 to 3 are vertical sectional front views of the first to third embodiments of the present invention, respectively.

Now referring to FIG. 1 which shows the first embodiment of the present invention, numeral 15 designates a cylinder having a tool 16 such as a chisel slidably mounted in its bottom end. In the cylinder 15 is mounted a piston 18 adapted to strike the tool 16 with its downward stroke. The piston 18 is formed with an upper large-diameter portion 21 and a lower large-diameter portion 22 of an equal diameter between upper and lower small-diameter portions 19 and 20 of an equal diameter, and is further formed with a middle small-diameter portion 23 between the large-diameter portions 21 and 22.

The cylinder 15 is formed with an upper chamber 25 charged with nitrogen gas. The gas pressure acts on the top of the piston 18 when it is in an elevated position. A middle chamber 28 and a lower chamber 29 are formed between the inner periphery of the cylinder and the small-diameter portions 19 and 20 of the piston 18 formed above the upper large-diameter portion 21 and below the lower large-diameter portion 22, respectively.

The cylinder 15 is provided at one side thereof with a valve casing 31 in which is formed a valve chest 30. A valve body 33 formed with a center bore 32 is slidably mounted in the valve chest 30.

The valve chest 30 has its upper and lower portions communicating with the upper part of the middle chamber 28 and the lower chamber 29 through oil channels 35 and 36, respectively.

An oil pressure chamber 45 is provided over the valve chest 30. A plunger 46 is slidably mounted in the passage connecting the oil pressure chamber 45 with the valve chest 30 with its bottom end in contact with the top of the valve body 33. The valve body has an upper large-diameter portion 47 and a lower small-diameter portion 48 which are slidably mounted in a large-diameter portion and a small-diameter portion of the valve chest 30, respectively. A space formed between the bottom end face of the large-diameter portion 47 and the valve chest 30 serves as an actuating chamber 49.

The small-diameter portion 48 of the valve body 33 is formed in its outer periphery at the lower part with an annular groove 50. The valve chest 30 is formed in its large-diameter portion with upper and lower annular grooves 52 and 53 and in its small-diameter portion with upper, middle and lower annular grooves 54, 55 and 56. The annular grooves 53, 54 and 56 are in communication with oil channels 37, 38 and 36, respectively. An oil feed port 58 formed in the valve casing 31 communicates with the oil pressure chamber 45 and the annular groove 55. An oil discharge port 59 communicates with the annular groove 52.

The plunger 46 has a sectional area smaller than the difference in the sectional area between the large-diameter portion 47 and the small-diameter portion 48 of the valve body 33.

The middle chamber 28 is formed at its top with an annular groove 40 communicating with the oil channel 35. The lower chamber 29, too, is formed with an annular groove 42 communicating with the oil channel 36.

Further, the cylinder 15 is formed in its inner periphery with annular grooves 43 and 44 which are so positioned as to communicate with the middle small-diameter portion 23 when the piston is at its lowermost position. The annular groove 43 opens to the annular groove 52 formed in the valve chest 30 through an oil channel 34. The annular groove 44 opens to the annular groove 53 in the valve chest 30 through the oil channel 37 which also leads to the annular groove 54 through a small-diameter oil channel 38 branching from the channel 37. The oil channel 36 leads to the annular groove 55 through an extra-narrow oil channel 39.

In operation, when the piston 18 and the valve body 33 are both at the lowermost position as in FIG. 1, pressure oil supplied through the oil feed port 58 flows through the annular groove 55, annular outer peripheral groove 50, annular groove 56 and oil channel 36 into the lower chamber 29 to apply pressure on the lower end face of the lower large-diameter portion 22 of the piston. In this state, the middle chamber 28 is open to the discharge port 59 through the oil channel 35, the upper part of the valve chest 30 and annular groove 52. Thus, the piston 18 begins to rise while compressing the nitrogen gas in the upper chamber 25. At the same time, pressure oil flows through the oil feed port 58 into the oil pressure chamber 45 to push down the plunger 46 and thus the valve body 33.

When the piston 18 rises further until the lower large-diameter portion 22 does not interrupt the communication between the annular groove 44 and the lower chamber 29, the pressure oil in the lower chamber 29 flows into the actuating chamber 49 through the annular groove 44 and oil channel 37 to exert pressure on the lower end face of the large-diameter portion 47 to raise the valve body 33.

When the valve body 33 rises up to a predetermined position, the connection between the annular grooves 55 and 56 is cut off and instead connections are established between the annular grooves 55 and 54 and between the annular grooves 56 and the bottom of the valve chest 30. Now, the lower chamber 29 opens to the discharge port 59 through the oil channel 36, annular groove 56, bottom of the valve chest 30 and center bore 32, so that the pressure in the lower chamber 29 decrease, allowing the piston to descend under the pressure of the nitrogen gas in the upper chamber 25.

Though the communication between the annular groove 44 and the lower chamber 29 is cut off by the lower large-diameter portion 22 while the piston is descending, pressure oil is kept being supplied to the actuating chamber 49 through the annular grooves 55 and 54, small-diameter oil channel 38 and oil channel 37, thus keeping the valve body 33 rising. When the valve body 33 comes close to its upper limit, the large-diameter portion 47 interrupts the communication between the upper portion of the valve chest 30 and the annular groove 52, so that the oil in the lower chamber 29 flows into the middle chamber 28.

In this state, pressurized oil is admitted into the lower chamber 29 and then into the middle chamber 28 through the annular groove 55, extra-narrow oil channel 39 and oil channel 36 to increase the pressure in the lower chamber 29 and the middle chamber 28.

The difference of sectional area between the upper small-diameter portion 19 and the upper large-diameter portion 21 is equal to that between the lower small-diameter portion 20 and the lower large-diameter portion 22. Therefore, if the lower chamber 29 and the middle chamber 28 are put under the same pressure, the piston 18 will not be prevented from descending.

When the piston 18 is lowered to such a position that the annular grooves 43 and 44 get into communication with each other through the space formed by the middle small-diameter portion 23, the actuating chamber 49 opens to the discharge port 59 through the annular groove 53, oil channel 37, annular grooves 44 and 43 and oil channel 34. Thus the actuating chamber 49 shows a sharp drop in pressure, allowing the valve body 33 to be pushed down by the plunger 46 to the lowermost position shown in FIG. 1.

While the valve body 33 is moving down, pressure oil is supplied to the actuating chamber 49 through the small-diameter oil channel 38. But its influence on the downward movement of the valve body is negligible since the flow of oil into the actuating chamber 49 is restricted by the small-diameter oil channel 38. Thus, the piston 18 strikes the tool 16 with the middle chamber 28 and lower chamber 29 pressurized. This prevents the oil pressure in the lower chamber 29 from dropping sharply owing to the reaction of the piston 18 after striking the tool, thus checking the growth of air bubbles in the oil.

By the reaction of the piston 18, the middle chamber 28 is momentarily put under a higher pressure than in the lower chamber 29. Thus, the pressure in the valve chest 30 will become higher at the upper part than at the lower part. The valve body 33 is thus pushed down. When the large-diameter portion 47 of the valve body 33 passes the annular groove 52, the middle chamber 28 and lower chamber 29 communicate with the discharge port 59, undergoing a sharp decline in pressure. The pressure in the actuating chamber 49 will decline simultaneously, allowing the valve body 33 to be pushed down by the plunger 46 to the lowermost position shown in FIG. 1. The abovesaid operation is repeated as long as the supply of pressure oil through the oil feed port 58 continues.

Figure 2:
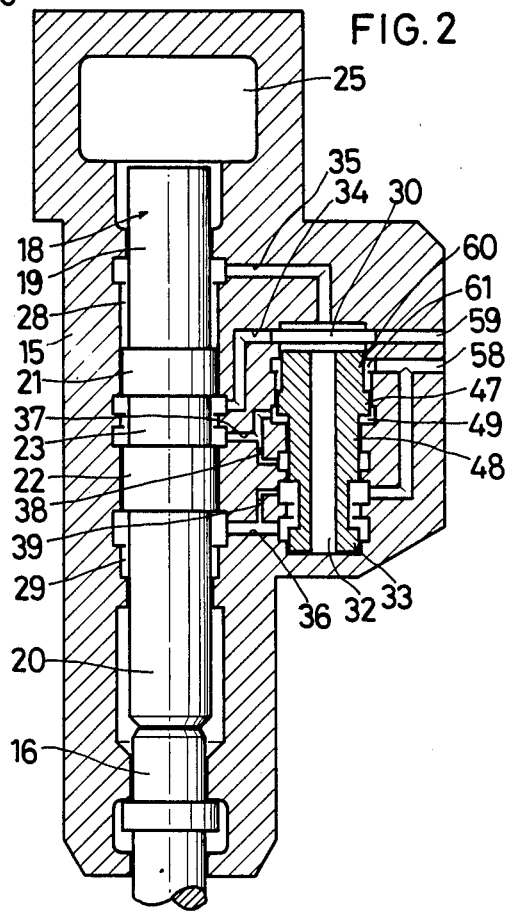

In the second embodiment shown in FIG. 2, the valve body 33 is formed with a medium-diameter portion 60 above the large-diameter portion 47 instead of providing the plunger 46 and the oil pressure chamber 45 as in the first embodiment. Between the medium-diameter portion 60 and the peripheral wall of the valve chest 30 is formed a chamber 61 which is normally in communication with the oil feed port 58. The difference in the sectional area between the large-diameter portion 47 and the medium-diameter portion 60 should be smaller than that between the large-diameter portion 47 and the small-diameter portion 48. The valve body in this embodiment operates completely in the same manner as that shown in the first embodiment.

In the first and second embodiments, when the piston 18 rises to such a position that the lower large-diameter portion 22 does not block the communication between the annular groove 44 and the lower chamber 29, pressure oil is allowed to flow into the actuating chamber 49, thus moving the valve body 33 upwardly.

In order to ensure that the valve body 33 be pushed up, pressure oil flows into the actuating chamber 49 through the annular groove 55, annular groove 54, small-diameter oil channel 38 and oil channel 37.

Figure 3:
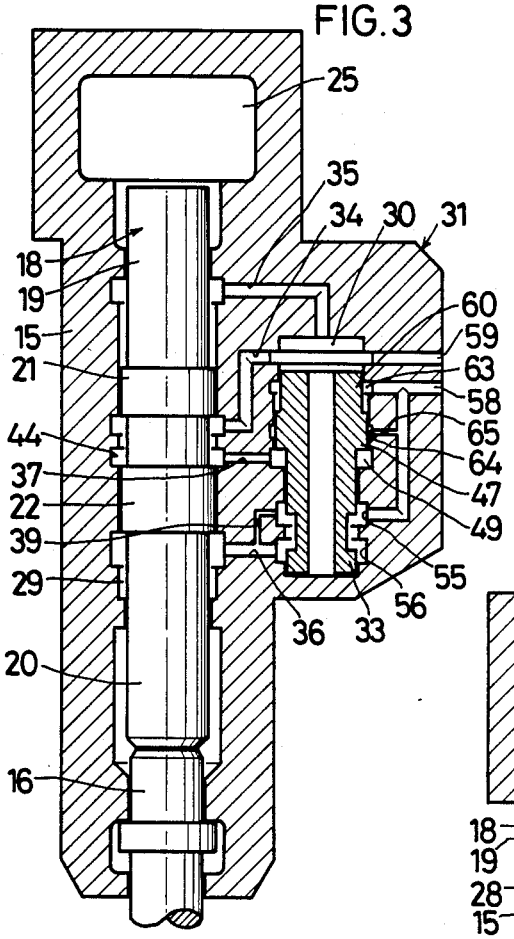

In the third embodiment shown in FIG. 3, the valve body 33 is formed at its top with a medium-diameter portion 60 to form a chamber 63. The valve chest 30 is formed in its upper periphery with an annular groove 64 through which the large-diameter portion 47 of the valve body 33 slides up and down. The annular groove 64 communicates with the oil feed port 58 through a small-diameter oil channel 65. The annular groove 64 is formed in such a position that the actuating chamber 49 will communicate with the annular groove 64 through the space formed under the large-diameter portion 47 when the valve body has risen to such a position as to cut off the communication between the annular grooves 55 and 56 and to put the annular groove 56 and the lower part of the valve chest 30 in communication.

Thus in the third embodiment, when the valve body 33 gets close to the upper limit, pressure oil flows through the small-diameter oil channel 65 and the annular groove 64 into the actuating chamber 49 so that it will act upon the bottom end face of the large-diameter portion 47, keeping the valve body 33 at its uppermost position. The small-diameter oil channel 38 employed in the first and second embodiments is done away with in this embodiment. Otherwise this embodiment is substantially the same in construction and operation as the first and second embodiments.

Figure 4:
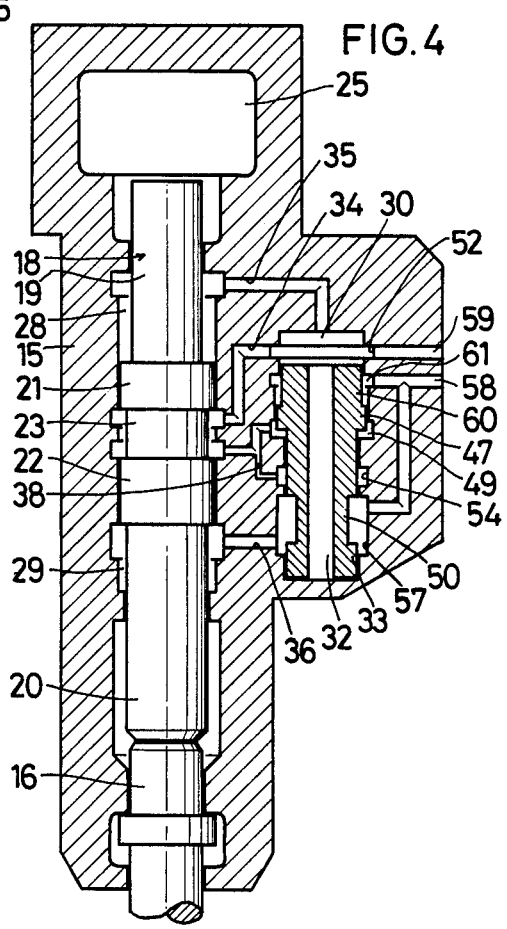
FIG. 4 is a similar view of the fourth embodiment of the same.
Figure 5:
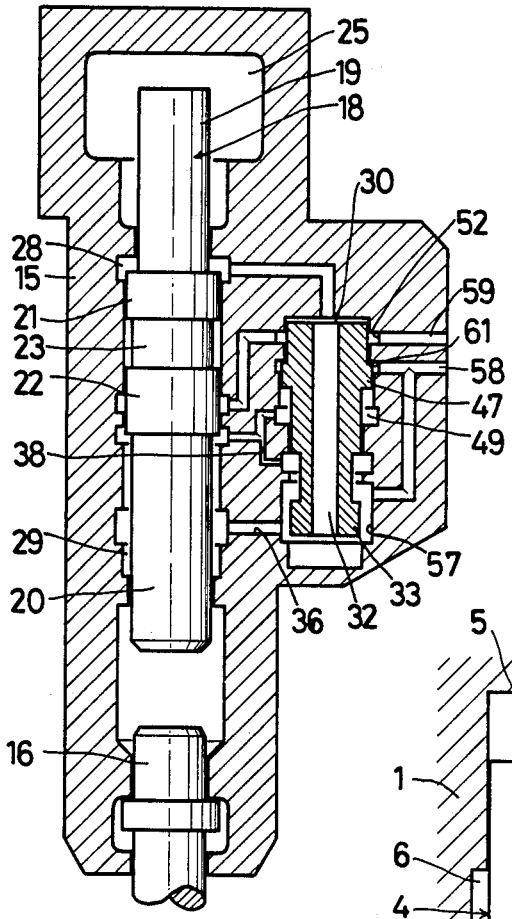
FIG. 5 is a similar view of the same showing a different state of operation.
Figure 6:
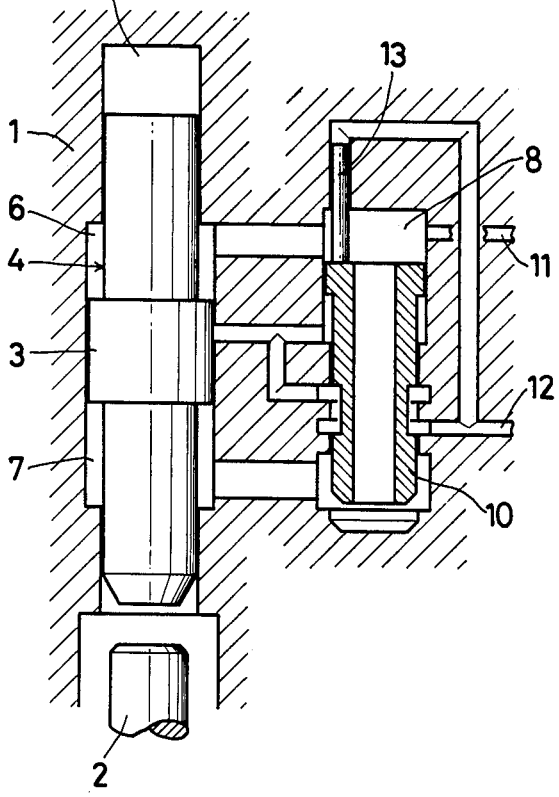
FIG. 6 is a similar view of a prior art impact tool.

The fourth embodiment shown in FIGS. 4 and 5 differs from the previous embodiments in that the small-diameter portions 19 and 20 have different diameters. This embodiment is a modification of the second embodiment (FIG. 2) and both embodiments have substantially the same circuit construction.

In this embodiment, the upper small-diameter portion 19 has a smaller diameter than the lower small-diameter portion 20. Thus, when the middle chamber 28 and the lower chamber 29 are under the same oil pressure, the piston 18 is urged downwardly.

The fact that the upper small-diameter portion 19 and the lower small-diameter portion 20 have the same diameter presents a problem that the pressure at the oil feed port 58 tends to be higher when the piston is descending than when rising because the pressure oil supplied from a pump is not consumed during the downward stroke of the piston. Thus it is necessary to provide an accumulator in the line leading to the oil feed port 58 to minimize the pressure fluctuation.

In this embodiment, since pressure oil is consumed even during the downward stroke of the piston 18, pressure fluctuation is minimal, making it possible to eliminate an accumulator. This arrangement is applicable in any of the other embodiments.

Also in this embodiment, the valve body 33 has its lower part below the annular outer peripheral groove 50 prolonged. The valve chest 30 has its bottom deepened to receive the prolonged portion of the valve body 33. Further, the valve chest 30 is formed with a wide annular groove 57 in place of the annular grooves 55 and 56 and the extra-narrow oil channel 39. Thus as shown in FIG. 12, the rising valve body 33 can clear the bottom edge of the annular groove 57 to connect the center bore 32 with the lower chamber 29, only after having sealed the annular groove 52 with its head to cut off the communication between the bore 32 and the discharge port 59.

This structure allows the lower chamber 29 to be normally open to the oil feed port 58 and to be kept under higher pressure compared with the other embodiments. Thus with this embodiment, air bubbles are prevented from growing and erosion resulting from cavitation is effectively prevented.

What is claimed is:

1. A hydraulic impact tool for striking a tool such as a chisel, comprising:

a cylinder having the tool slidably mounted therein at lower end thereof;

a piston reciprocably mounted in said cylinder for striking the tool during its downward movement, wherein said piston having an upper small-diameter portion and a lower small-diameter portion and upper and lower large-diameter portions between said upper and lower small-diameter portions, and a middle small-diameter portion between said upper and lower large-diameter portions, wherein said cylinder having an upper chamber filled with a gas to apply gas pressure to the top of said piston, and a middle chamber and a lower chamber defined directly above said upper large-diameter portion and directly below said lower large-diameter portion, respectively;

a valve chest connected to said middle chamber and said lower chamber and an oil supply port and an oil discharge port;

a valve body slidably mounted in said valve chest; and an oil circuit having an oil passage communicating said middle small-diameter portion with said valve chest for controlling the communication between said middle chamber and said lower chamber on one hand and said oil supply port and said oil discharge port on the other hand to alternately raise and lower said piston under the pressure of said gas and oil, and wherein said oil circuit is so arranged that prior to said piston striking the tool, the pressure oil will be fed into said lower chamber to increase the oil pressure in said lower chamber, and wherein said middle small-diameter portion communicates with said valve chest through said oil passage to raise and lower said valve body in said valve chest.

2. A hydraulic impact tool as claimed in claim 1, wherein said upper small-diameter portion has a smaller diameter than said lower small-diameter portion, in order to lower said piston both by the pressure of the gas in said upper chamber and by the difference between the oil pressure applied to the top of said upper large-diameter portion and the oil pressure applied to the bottom of said lower large-diameter portion.

* * * * *